US005553521A

United States Patent [19]

Dunn

[11] Patent Number: 5,553,521

[45] Date of Patent: Sep. 10, 1996

[54] DOOR SPRING ADJUSTING TOOL

[76] Inventor: David S. Dunn, 5409 Marshburn Ave., Arcadia, Calif. 91006

[21] Appl. No.: 274,223

[22] Filed: Jul. 13, 1994

[51] Int. Cl.[6] ..... B25B 33/00

[52] U.S. Cl. ..... 81/484; 81/461

[58] Field of Search ..... 81/484, 486, 488, 81/176.1, 176.15, 461, 451

[56] References Cited

U.S. PATENT DOCUMENTS

| | | | |
|---|---|---|---|
| 2,601,795 | 7/1952 | Maxe et al. | 81/484 |
| 3,564,949 | 2/1971 | Hedrick | 81/461 X |
| 3,821,975 | 7/1974 | Haker | 81/461 |
| 4,794,683 | 1/1989 | Pacheco | 81/488 X |
| 4,979,409 | 12/1990 | Garrett et al. | 81/484 |
| 5,018,414 | 5/1991 | Naumann | 81/488 X |
| 5,123,314 | 6/1992 | Wittmann | 81/484 |
| 5,370,022 | 12/1994 | Rodriguez et al. | 81/451 X |

OTHER PUBLICATIONS

Instruction Manual, published by Rixon–Firemark od Franklin Park, Illinois, 1970, pp. 1–2, includes ten photographs of wrench.

*Primary Examiner*—D. S. Meislin
*Attorney, Agent, or Firm*—Christie, Parker & Hale, LLP

[57] ABSTRACT

A device for adjusting the spring tension in a door closer in situ comprises body having a front side and back side surface. Mounting screw openings are disposed within the body and are positioned at locations corresponding to locations of selected locking screws.in the closer used to secure a spring cover. Mounting screws are disposed within respective mounting screw openings. A centrally positioned cavity is disposed within the body and accommodates rotatable placement of an adjustment shaft therein. The adjustment shaft comprises a hexagonal head extending outwardly from the front side surface, and is attached to an adjustment assembly comprising a drive disk extending outwardly from the back side surface of the device. Adjustment pins extend outwardly from the drive disk and are numbered and configured to correspond to adjustment holes in the spring cover. In situ adjustment of the closer is effected by removing selected locking screws, lowering the device into place against the closer and effecting engagement of the mounting screws and adjustment pins with exposed locking screw openings and adjustment holes, respectively, tightening the mounting screws to snugly fit against the closer, loosening the remaining locking screws, rotating the spring cover by rotating the hexagonal head to provide desired degree of spring tension, tightening the remaining locking screws, untightening the mounting screws, removing the device from the closer, and replacing and tightening the removed locking screws.

17 Claims, 3 Drawing Sheets

37
40
32
10

58
4
58
4
56
54
42
40
37
42
40
30
37

37

10
36
60
48
46
64
64
50
63
46
36
62
38
37
64
64
34
38
30
37
46

DOOR SPRING ADJUSTING TOOL

FIELD OF THE INVENTION

This invention relates to a mechanism used to control the opening and closing of swinging doors and, more particularly, to a device for adjusting such mechanism.

BACKGROUND OF THE INVENTION

Swinging doors are commonly used at the entrances of most public buildings, shopping malls, department stores, business buildings and the like. Such swinging doors are typically configured to open inwardly into the particular building or outwardly from the building and comprise two adjacent door members, generally made from glass, wool, steel and the like, that are pivotally mounted at top and bottom portions of non-adjacent ends to supporting members in the floor and in an upper portion of a door frame, respectively. The doors, when placed in the closed position, are positioned adjacent one another about adjacent ends opposite to the pivotally attached ends. Accordingly, both doors are opened by pushing a handle or rail positioned near each adjacent end, causing the adjacent ends of each door to move outwardly and away from one another in a pivoting manner.

The doors are configured to both open in response to a predetermined amount of force imparted to the hand rail, and close in a controlled manner by use of a door closer attached to the nonadjacent ends of each door at each door bottom via a pivot arm. The pivot arm is attached within the closer to a spring mechanism that controls the amount of resistance needed to open the door. Once the door is opened, the door is returned to its closed position by the return action of the spring mechanism that is hydraulically dampened to prevent the door from slamming shut.

The door closure is configured at the factory and installed into buildings with the spring tension of the spring mechanism set to a predetermined amount. As temperature outside of a building changes, due to the changing seasons, so does the internal heating and cooling of the building. In large buildings, the amount or volumetric flow rate of cool air needed to provide a comfortable indoor temperature during the hot summer months often results in the creation of a positive pressure differential between indoor and outdoor environment, i.e, the pressure inside the building is greater than the atmospheric pressure outside the building. This additional indoor pressure imparts a sufficient pressure force against the doors to cause the doors to open a small amount defined by the equilibrium point between the pressure force of the air inside the building and the spring force imposed by the door closer.

Accordingly, to accommodate the positive pressure created by a building's cooling system within a building during the Summer months the spring tension on the door closer must be adjusted from its preset amount, i.e., tightened, to overcome such positive pressure. It is typically easier to heat the inside of a building than cool the same building. Therefore, during the Winter months the problem of positive pressure within the building does not exist, rather, the spring tension of the door closer must be adjusted, i.e., loosened, from its Summer position back to the preset condition so that the opening of the doors is not overly difficult.

Recent passage of the American Disabilities Act also imposes limitations on the amount of force that is required to open such swinging doors installed in public and private buildings. Under the Act, the amount of force needed to open such doors must not be overbearing so as to facilitate operation of the door by people with a disability or by senior citizens. Although no firm number has been provided, it is believed that in order to meet the criteria under the Act the spring tension for the door closers will need to be adjusted to about 8½ pounds. The spring tension of the door closing mechanism preset at the factory and installed in existing buildings is approximately 10½ pounds. Therefore, in order to comply with the Act the spring mechanism in door closers in all public and private buildings must either be adjusted, i.e., loosened, or be replaced with new lower spring tension door closers, an option that is not economically desirable.

The door closer does not comprise a simple adjustment mechanism, thus, the act of adjusting the spring mechanism is a complex operation requiring the removal of both doors, the removal of a threshold member extending along the floor covering the door closers, and the removal of the door closers from their position mounted within the floor. The doors closers are then either returned to the factory or taken to a machine shop where the door closer can be secured in a vice while a spring cover is loosened and adjusted to either relieve or increase the spring tension of the spring within. Once adjusted, the door closers are replaced and the doors are reassembled. Accordingly, this method of adjusting the spring mechanism in a door closer is difficult to implement, time consuming, inconvenient, and costly. Also, during the adjustment process the unassembled condition of the doors are potentially dangerous and unsightly to people visiting the building.

It is, therefore, desirable that a device be provided to facilitate the adjustment of spring tension within a door closer without the need to remove the door closer from its floor mounted position. It is desirable that the device be configured in a manner accommodating simple operation by use of conventional hand tools. It is also desirable that the device be economical to manufacture and, thus be constructed using both conventional manufacturing techniques and conventional building materials.

SUMMARY OF THE INVENTION

Toward this end, the present invention provides a device for adjusting the spring tension of a door closer in situ. The device comprises a body having a generally planer configuration having a front side and back side surface. Mounting screw openings are disposed within the body at predetermined locations adjacent peripheral edges of the body. The mounting screw openings are positioned at locations that correspond to the locations of selected locking screws used to secure a spring cover to the door closer. Mounting screws are disposed within respective mounting screw openings.

The body comprises a centrally positioned cavity that accommodates the rotatable placement of an adjustment shaft therein. The adjustment shaft comprises a hexagonal head extending outwardly from the front side surface of the device. An adjustment assembly is attached to the adjustment shaft and comprises a drive disk extending outwardly from the back side surface of the device and adjustment pins extending outwardly from the drive disk. The attachment pins are numbered and configured to correspond to adjustment holes in the spring cover.

The spring adjusting device is use to adjust the spring tension in the closer in situ by removing selected locking screws, lowering the device into place against the closer such that the mounting screws engage the exposed locking screw openings and the adjustment pins engage the adjustment holes, tightening the mounting screws so that the device is snugly fit against the closer, loosening the remaining locking screws, rotating the spring cover by rotation of the hexagonal head to provide desired degree of spring tension, tightening the remaining locking screws, untightening the mounting screws, removing the device from the closer, and replacing and tightening the removed locking screws.

BRIEF DESCRIPTION OF THE DRAWINGS

Features, aspects and advantages of the present invention will be more fully understood when considered in reference to the specification, claims and drawings wherein:

DETAILED DESCRIPTION OF THE INVENTION

Figure 1:
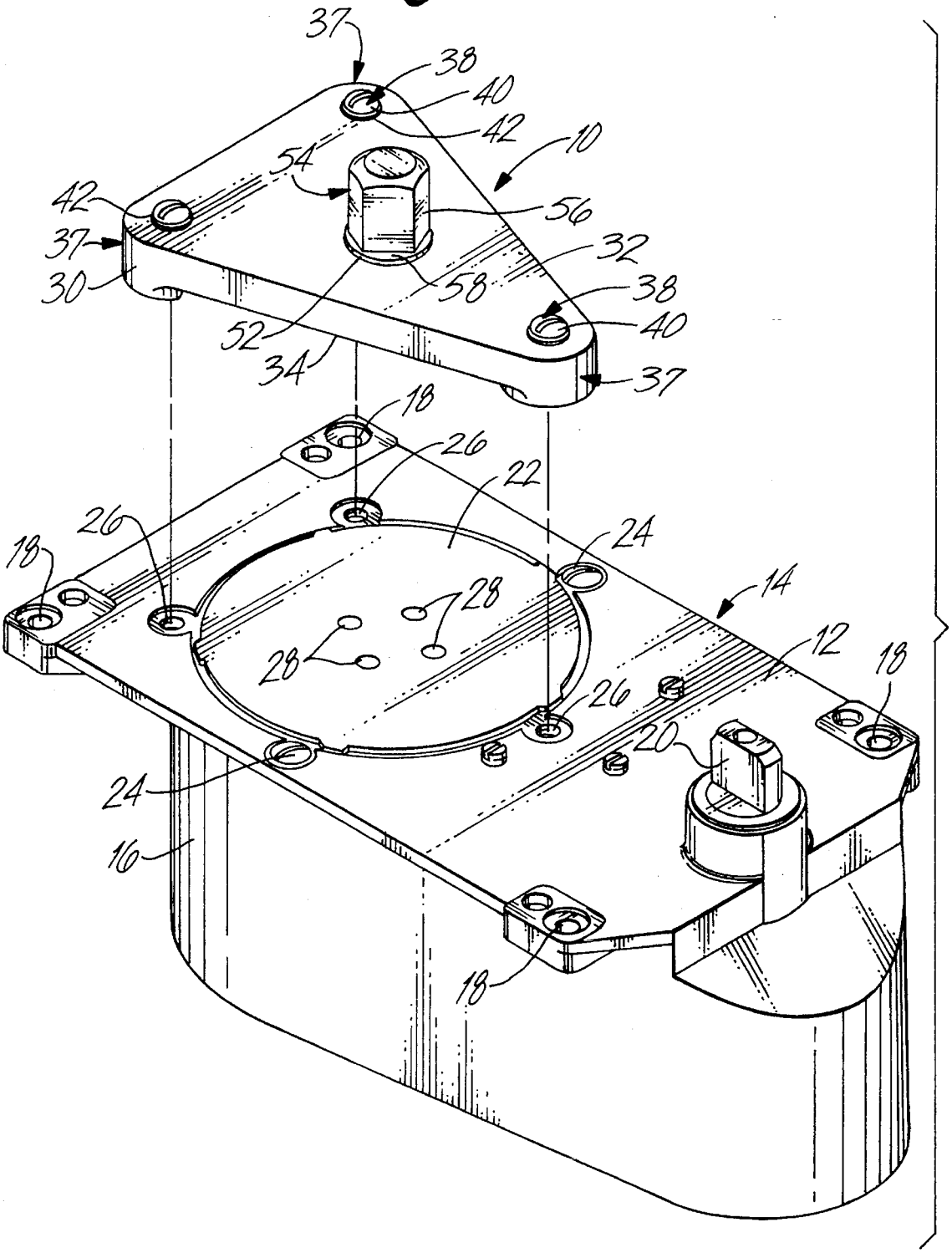
FIG. 1 is an isometric view of a preferred embodiment of the device constructed according to principles of this invention and a door closer in an unassembled state.

FIG. 1 illustrates a preferred embodiment of the device 10 positioned over a front side surface 12 of a door closer 14. The door closer comprises a body 16 that houses a spring mechanism (not shown), used to control the amount of resistance needed to open a door, and a hydraulic mechanism (not shown), used to dampen the closing action of a door after it has been opened so as to prevent the door from slamming shut. The body is fixedly attached, by mounting bolts (not shown) disposed through mounting holes 18, within a suitably sized cavity in the floor positioned beneath the door.

The spring and hydraulic mechanisms are connected to a bottom end portion of the door via an arm 20 that extends upwardly through the front side surface 12 a predetermined distance. The top end portion of the door, opposite the connection point with the arm 20, is connected to a freely rotatable arm (not shown) mounted in a top portion of a door frame. Accordingly, the opening and closing action of the door is accommodated by pivotable movement about both arms.

A spring cover 22 is disposed on the front side surface 12 of the door closer and is connected within the body to the spring mechanism 16, so that rotational movement of the spring cover vis-a-vis the body effects the spring tension imposed on the door. The spring cover is configured having a circular disk-like shape and extends a predetermined distance away from the front side surface of the closer body 16. Referring to FIG. 1, to increase the spring tension imposed on the door, i.e., to increase the amount of force needed to open the door, the spring cover is rotated about the closer body 16 in one direction. Conversely, to decrease the level of spring tension imposed on the door, i.e., to decrease the amount of force needed to close the door, the spring cover is rotated about the closer body 16 in an opposite direction.

Locking screws 24 are disposed in locking screw openings 26 within the front side surface 12 adjacent the peripheral edge of the spring cover 22. The locking screws serve to keep the spring cover in a fixed position against the body to resist rotational movement by the spring tension of the spring mechanism. Without the locking screws, the spring mechanism would release its spring tension through the rotational movement of the spring cover about the body. As shown in FIG. 1, the door closer comprises approximately five locking screws positioned at equidistant locations around the spring cover.

Adjustment holes 28 are positioned near the center of the spring cover 22 and extend a predetermined distance into the cover surface. As shown in FIG. 1, the door closer comprises approximately four adjustment holes 28 arranged in a square pattern. As will be discussed in greater detail below, the adjustment holes provide an attachment point for the device 10 for purposes of accommodating rotational movement of the spring cover vis-a-vis the body 16.

The device comprises a body 30 having a generally planer configuration with a front side surface 32 and a back side surface 34. In a preferred embodiment, the body is configured in the shape of an oblique triangle to accommodate attachment with three selected locking screw openings 26 in the door closer. However, it is to be understood that the body may be configured in other geometric shapes such as a circle, rectangle, square and the like. The body can be made from conventional tool materials such as steel, steel alloy, iron, aluminum, and the like using conventional manufacturing techniques well known in the art such as machining, stamping and the like. In a preferred embodiment, the body is machined from aluminum and anodized.

Referring to FIGS. 1–4, the device comprises a number of mounting screw openings 36 that extend through the body 30. The mounting screw openings 36 are positioned at locations that correspond with selected locking screw openings 26 in the door closer body 16 when the back side surface 34 of the device is placed adjacent with the front side surface 12 of the door closer. In a preferred embodiment, the device comprises approximately three mounting screw openings 36 that are each positioned near a respective corner portion 37 of the triangle-shaped body. It is preferred that the mounting screw openings 36 be located in this manner to provide a stable and balanced attachment with the closer body 12, thereby eliminating the possibility that the device will move or wobble during use.

Mounting screws 38 are disposed within the mounting screw openings 36 and comprise a head portion 40 adjacent the front side surface 32 and a threaded portion extending a predetermined length from the back side surface 34 of the body 30. A washer 42 is interposed between each mounting screw 38 and the front side surface 32. Each mounting screw comprises a non-threaded portion 44 (see FIG. 4) adjacent the back side surface 34 that accommodates the placement of a retaining clip 46 thereon. The retaining clip ensures that each mounting screw will not fall out of its respective mounting screw opening when the front side surface 34 is inverted. The mounting screws may be of the conventional type having a head portion configured to accommodate engagement with conventional hand tools. In a preferred embodiment, the mounting screws each have a head portion 40 that accepts a conventional standard-type screwdriver, have a length of approximately 1 inch, have a right-hand thread pattern corresponding to a No. 12 machine screw, and extends from the back side surface 34 approximately ¼ inch.

Figure 2:
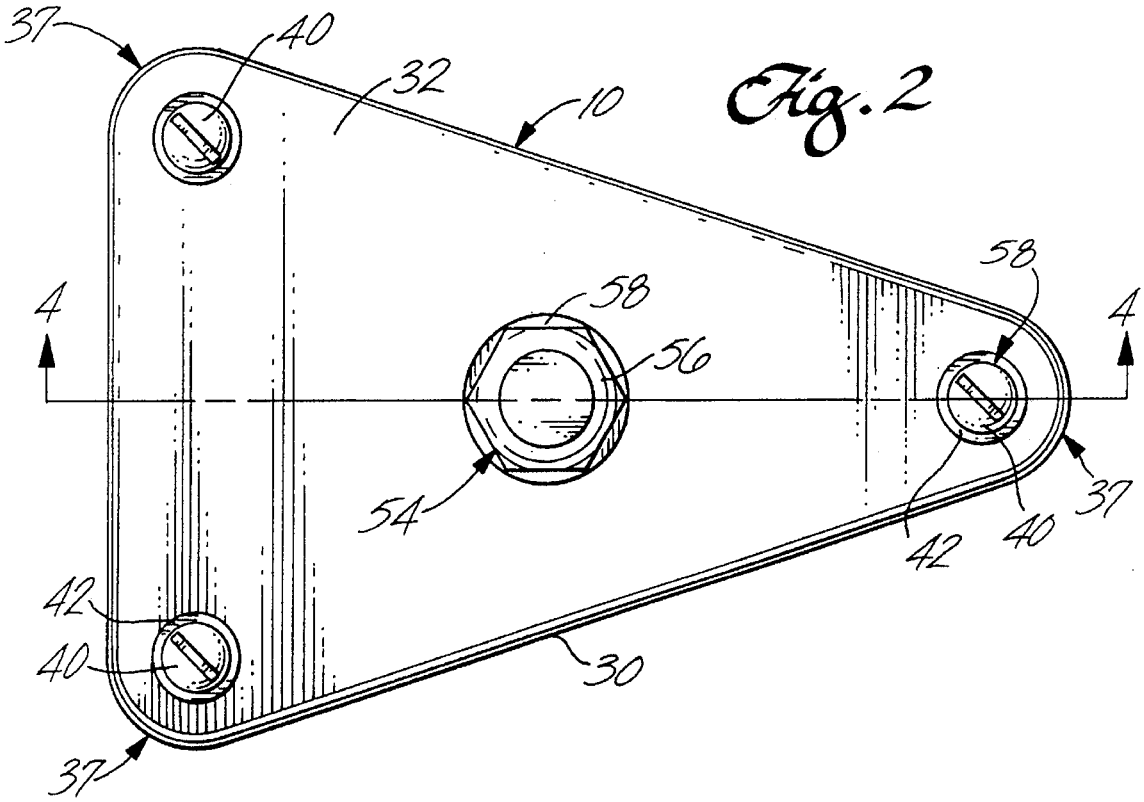
FIG. 2 is a top plan view of the preferred embodiment of the device in FIG. 1.
Figure 3:
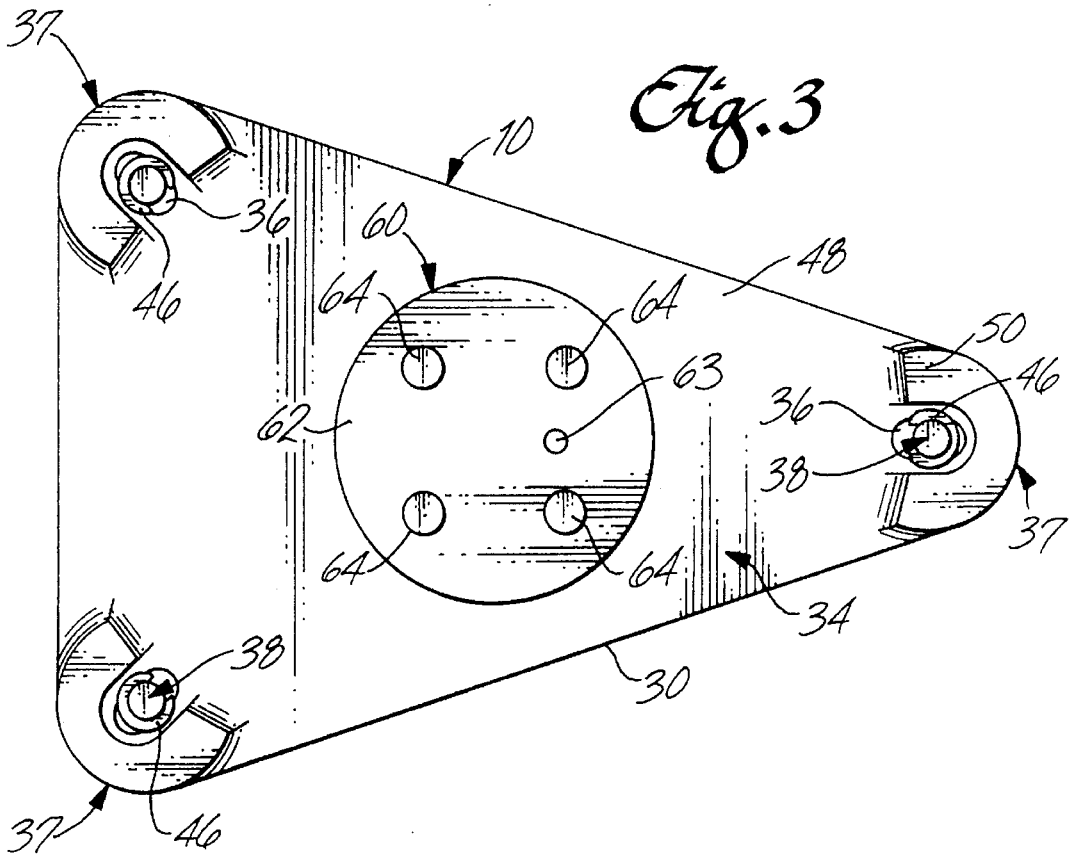
FIG. 3 is a bottom plan view of the preferred embodiment of the device in FIGS. 1 and 2.
Figure 4:
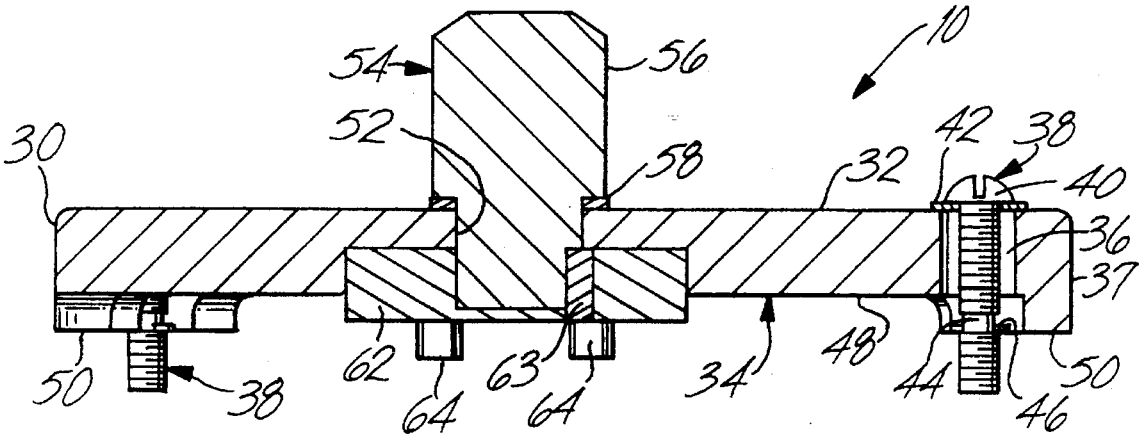
FIG. 4 is a cross sectional side view of the preferred embodiment of the device across section 4—4 in FIG. 2.

Referring to FIG. 2, the front side surface 32 is configured having a flat surface. Referring to FIG. 3, the back side surface 34 in configured having a first flat portion 48 remote from the corner portions 37, and second flat portions 50 at each corner portion that are on a different plane than the first flat portion. As best shown in FIG. 4, the second flat portions 50 reside along a plane below the plane defined by the first flat portion 48, i.e., the first flat portion is a recessed surface with respect to the second flat portions. It is desired that the back side surface be configured having a centrally recessed first flat portion to accommodate the attachment of the device onto the door closer in a manner that does not interfere with rotational movement of the spring cover. The spring cover extends upwardly a small distance from the front side surface 12, therefore, a device having a uniformly planer back side surface 34 would interfere with the rotational movement of the spring cover after the device has been attached.

Referring still to FIG. 4, the device comprises a centrally located cavity 52 extending through the body 30. The cavity extends from the front side surface 32 a predetermined distance through the body having a diameter of uniform size. A portion of the cavity near the center of the body has a increased diameter that extends to the back side surface 34. In a preferred embodiment, the portion of the cavity adjacent the front side surface has a diameter of approximately 0.65 inches, and the portion of the cavity adjacent the back side surface has a diameter of approximately 1.76 inches.

An adjustment shaft 54 is rotatably disposed within the cavity 52 from the front side surface 32 and comprises a head portion 56 extending outwardly away from the front side surface a predetermined distance. The head may be configured having a number of different geometries such as square, rectangular, hexagonal and the like to accommodate rotational movement of the adjustment shaft. For purposes of ease and convenience of use, it is preferred that the head portion be configured to accommodate rotational movement using conventional hand tools such as a socket wrench. For this reason, in a preferred embodiment, the head portion is configured having a hexagonal shape and sized to accommodate attachment with a standard ¾ inch socket. A thrust washer 58 is interposed between the front side surface 32 and the head portion 56 to accommodate a predetermined amount of space between the two and ensure perpendicular alignment of the adjustment shaft 54 within the cavity.

An adjustment pin assembly 60 is disposed within the cavity 52 from the back side surface 34 and comprises a drive disk 62 fixedly attached to the adjustment shaft 54 within the cavity by a shear pin 63 (see FIGS. 3 and 4). The adjustment shaft has a predetermined length such that the attachment of the drive disk does not impair rotational movement of the shaft and disk within the cavity. Additionally, the drive disk has an outside diameter of sufficient dimension to allow rotational movement within the increased diameter portion of the cavity adjacent the back side surface 34. The drive disk extends outwardly a predetermined distance from the back side surface. In a preferred embodiment, the drive disk extends from the back side surface approximately 3/16 inch.

A number of adjustment pins 64 are disposed in the drive disk 62 and extend outwardly a predetermined distance from the disk and the back side surface 34. The pins are sized and positioned within the disk to facilitate slidable cooperation within the adjustment holes 28 of the spring cover 22 when the device is attached to the door closer. In a preferred embodiment, the device comprises four adjustment pins each having a diameter of approximately ¼ inch arranged in a square pattern of approximately 13/16 inch. The adjustment pins each extend from the drive disk approximately ⅜ inch.

The embodiment of the spring adjustment device constructed according to principles of this invention has been described and illustrated for use with a door closer having a particular configuration. Specifically, the preferred embodiment is meant to facilitate spring tension adjustment of door closers manufactured by Rixson-Firemark of Franklin Park, Ill., and more specifically, of Rixson closer model numbers 25, 26, 27 and 28. However, it is to be understood within the scope of this invention that the spring adjustment device may be configured differently to accommodate spring tension adjustment of non-Rixson door closers as well. Therefore, this invention may be practiced otherwise than specifically described.

The spring adjusting device is used to adjust the spring tension of a door closer in situ, without having to remove the door closer from its location mounted within the floor beneath a door that it controls. After it has been determined that a door closer needs to be adjusted, e.g., its spring mechanism is providing either too much or not enough resistance to an opening force, the door is moved to a position exposing the threshold or closer cover plate that covers the mounting place of the closer. The front side surface 12 of the closer is wiped free of all foreign debris, especially around the five locking screws 24 and the four adjustment holes 28. A reference line is marked between the spring cover 22 and adjacent closer body 16 to indicate the existing position of the cover vis-a-vis the body in case it becomes necessary to reestablish the existing spring tension, e.g., in the event that all five locking screws are accidentally loosened to the point where the spring cover is allowed to rotate unchecked and relieve all spring tension.

Three of the five locking screws are loosed and removed as shown in FIG. 1. The three locking screws that are removed correspond in location to the triangular pattern of mounting screws 38 and mounting screw openings 36 in the body 30. The back side surface 34 of the spring adjusting device 10 is lowered downwardly onto the front side surface 12 of the closer such that the three mounting screws 38 engage respective locking screw openings 26, and the adjustment pins 64 engage respective adjustment holes 28 in the spring cover 22. Once the mounting screws and adjustment pins are properly engaged, the mounting screws are threaded into respective locking screw openings until the device 10 is snugly locked into place against the closer body.

Although a specific procedure has been described and illustrated in FIG. 1 for installing the device onto the closer, it is to be understood that the device may be installed onto the closer other than specifically described and illustrated. For example, it is to be understood that the mounting screws of the device may be mounted over and engaged with any three retaining screw openings on the closer that correspond to the triangular placement of mounting screws. Accordingly, the device may be mounted onto the closer in one of five different positions. Ultimately, the position of the device onto the closer may be dictated by the configuration of surrounding structural members used to mount the closer into the floor.

A suitable tool is fit over the head portion 56 of the adjustment shaft 54. In the preferred embodiment, a ¾ inch socket is fit over the hexagonal head portion. The socket is connected to a 24 inch breaker bar. The socket and breaker bar can be ⅜ inch, ½ inch, or ¾ inch drive. While holding pressure against the breaker bar, the remaining two locking screws 24 are loosened. The loosening of these remaining locking screws frees the spring cover from constraint against rotational movement. Accordingly, if sufficient pressure is not maintained on the breaker bar the spring cover will rotate to relieve the spring tension imposed by the spring mechanism.

With the spring cover free to rotate, the spring tension is reset by applying sufficient force on the breaker to either increase or decrease the amount of force required to open the door. If it is desired to increase the amount of force required to open the door, the spring cover is rotated in one direction vis-a-vis the closer body a predetermined amount from the reference line. Conversely, to decrease the amount of force the spring cover is rotated in an opposite direction vis-a-vis the closer body a predetermined amount from the reference line.

Once the desired spring tension setting is achieved, a pressure is maintained on the breaker bar and the two locking screws are tightened against the spring cover so that the spring cover is securely engaged with the body to restrict rotational movement. The three mounting screws are untightened and the spring adjusting device is removed from the closer. The three locking screws are replaced into respective locking screw openings and tightened so that the locking screws engaged the spring cover to further ensure against rotational movement. The threshold or closer cover plate is replaced over the closer and the door is placed back into its normal operating position. The force necessary to open the door is checked to make sure that the desired spring tension has been achieved, and if not repeat the above-described sequence of steps.

It is to be understood that although only one preferred embodiment of the spring adjusting device has been described and illustrated herein, many variations will be apparent to those skilled in the art. Since many such modifications may be made, it is to be understood that within the scope of the following claims, this invention may be practiced otherwise than specifically described.

What is claimed is:

1. A device for adjusting a spring mechanism in a door closer while the door closer remains in a floor mounted position, the device comprising:

a body;

a number of mounting screws extending through mounting screw openings in the body, wherein the mounting screw openings are positioned at locations corresponding to selected locking screws in the door closer; and an adjustment assembly rotatably disposed within a cavity near the center of the body, wherein the body comprises a planer front side surface and a backside surface having a first flat portion that is recessed from second flat portions, wherein the mounting screws are located at the second flat portions.

2. The device as recited in claim 1 wherein the adjustment assembly comprises a number of adjustment pins.

3. The device as recited in claim 2 wherein the adjustment pins are numbered and arranged to correspond with adjustment holes in the door closer.

4. The device as recited in claim 3 wherein the device comprises four adjustment pins arranged in a square pattern.

5. The device as recited in claim 1 comprising an adjustment shaft attached to the adjustment assembly, wherein the adjustment shaft comprises a head portion that extends a predetermined distance from the front side surface of the body.

6. The device as recited in claim 1 wherein the body is configured in the shape of a triangle and the mounting screw openings are each located at corner portions of the body.

7. The device as recited in claim 6 wherein the adjustment assembly is located at the first flat portion.

8. A device for performing an in situ adjustment of a spring mechanism within a door closer, the device comprising:

a body having a substantially planer configuration and a front side and back side surface, wherein a number of openings extend through the body near peripheral edges, wherein the back side surface comprises a first flat portion recessed from second flat portions positioned near the openings;

a mounting screw disposed within each opening;

an adjustment shaft rotatably disposed within a cavity extending through the body, wherein the shaft comprises a head portion extending outwardly a predetermined distance from the front side surface of the body; and an adjustment pin assembly partially disposed within the cavity adjacent the back side surface, wherein the adjustment pin assembly extends outwardly away from the first flat portion, and wherein the second flat portions extend beyond a plane defined by the first flat portions to accommodate contact with the door closer, the adjustment pin assembly comprising:

a drive disk attached to the adjustment shaft and extending outwardly away from the back side surface; and a number of adjustment pins attached to the drive disk.

9. The device as recited in claim 8 wherein the mounting screws each comprises a threaded portion that extends a predetermined distance from the back side surface to accommodate threadable engagement with locking screw openings used to secure a spring cover in the door closer.

10. The device as recited in claim 8 wherein the openings are positioned at locations in the body that correspond in location with preselected locking screws used to secure a spring cover in the door closer.

11. The device as recited in claim 10 wherein the body is configured in the shape of a triangle comprising three openings positioned at each corner portion.

12. The device as recited in claim 8 wherein adjustment pins are numbered and arranged to correspond with adjustment holes disposed within a spring cover in the door closer.

13. The device as recited in claim 12 wherein the device comprises four adjustment pins arranged in a square pattern.

14. The device as recited in claim 8 wherein the head portion is configured in the shape of a hexagon to accommodate rotational movement by use of a conventional hand tool.

15. The device as recited in claim 8 wherein the mounting screws comprise retaining means attached to portions of the screws extending from the back side surface of the body to prevent the screws from falling out of the openings when the front side surface of the body is inverted.

16. A device for adjusting a spring within a door closer comprising:

a body having a substantially planer configuration and a front side and a backside surface;

mounting screws disposed in an equal number of mounting screw openings that each extend through the body, wherein the openings are positioned at locations that correspond with preselected locking screws used to secure a spring cover in the door closer; and an adjustment shaft rotatably disposed within a cavity extending through the body, wherein the shaft comprises:

a head portion at one end extending a predetermined distance from the front side surface; and an adjustment assembly at an opposite end extending a predetermined distance from the back side surface, wherein the assembly comprises adjustment pins that correspond in number and arrangement to adjustment holes in the spring cover, wherein the adjustment assembly is rotatable with the adjustment shaft, wherein the back side surface comprises a first flat portion recessed from second flat portions positioned near the mounting screw openings, wherein the adjustment assembly is positioned at the first flat portion.

17. The device as recited in claim 16 wherein the body is configured in the shape of a triangle and each mounting screw hole and respective mounting screw is located at corner portions of the body.

* * * * *